US007712278B2

(12) United States Patent
Lonardi

(10) Patent No.: US 7,712,278 B2
(45) Date of Patent: May 11, 2010

(54) ROOFING ASSEMBLY INCLUDING SHEET PANELS HAVING SIDE EDGE PORTIONS WITH PROJECTIONS MATING WITH GROOVES ON BRACKETS ANCHORED TO ROOF

(75) Inventor: Giorgio Lonardi, Marano di Valpolicella (IT)

(73) Assignee: ISCOM SpA, Pescantina (Verona) (IT)

( * ) Notice: Subject to any disclaimer, the term of this patent is extended or adjusted under 35 U.S.C. 154(b) by 0 days.

(21) Appl. No.: 11/912,888

(22) PCT Filed: Apr. 20, 2006

(86) PCT No.: PCT/IB2006/000935

§ 371 (c)(1),
(2), (4) Date: Oct. 27, 2007

(87) PCT Pub. No.: WO2006/117605

PCT Pub. Date: Nov. 9, 2006

(65) Prior Publication Data

US 2008/0184666 A1 Aug. 7, 2008

(30) Foreign Application Priority Data

Apr. 29, 2005 (IT) ..... VI2005A0129

(51) Int. Cl.
*E04D 1/34* (2006.01)

(52) U.S. Cl. ..... 52/551; 52/545; 52/588.1; 52/582.1

(58) Field of Classification Search ..... 52/588.1, 52/545, 506.05, 528, 529, 530, 800.1, 800.11, 52/551, 584.1, 582.1
See application file for complete search history.

(56) References Cited

U.S. PATENT DOCUMENTS

| | | | | |
|---|---|---|---|---|
| 4,285,182 | A * | 8/1981 | Dinges | 52/478 |
| 5,479,752 | A | 1/1996 | Menegoli | |
| 5,636,488 | A * | 6/1997 | Lawrence et al. | 52/521 |

FOREIGN PATENT DOCUMENTS

| | | | |
|---|---|---|---|
| DE | 4125900 | | 2/1993 |
| EP | 0124707 | | 11/1984 |
| EP | 0285479 | | 10/1988 |
| EP | 0306880 | | 3/1989 |
| EP | 0 634 535 | A2 * | 1/1995 |
| EP | 0964114 | | 12/1999 |
| JP | 4-146357 | * | 5/1992 |
| JP | 6-322901 | * | 11/1994 |

(Continued)

*Primary Examiner*—Gay Ann Spahn
(74) *Attorney, Agent, or Firm*—Themis Law

(57) ABSTRACT

A roofing structure for buildings, and more particularly a roofing assembly having high resistance, especially for use with roofs of residential and industrial buildings. The assembly comprises a plurality of sheet panels to be interconnected along side edge portions shaped to define a first longitudinal projection facing laterally outwards, and multiple mounting brackets to be anchored to a roof. Each bracket has at least one longitudinal groove to house in a snap fit relationship the first longitudinal projections of adjacent panels, so that the first longitudinal projections and the groove have opposing upper surfaces at least partly flat and substantially parallel or slightly inclined, in order to enhance the retaining action of the brackets and increase the separation load causing the separation of the edge portions from the brackets.

12 Claims, 4 Drawing Sheets

FOREIGN PATENT DOCUMENTS

| | | | |
|---|---|---|---|
| JP | 7-34606 | * | 2/1995 |
| JP | 8-42073 | * | 2/1996 |
| JP | 10-317593 | * | 12/1998 |
| JP | 2001-279878 | * | 10/2001 |
| JP | 2006-219924 | * | 8/2006 |

* cited by examiner

ROOFING ASSEMBLY INCLUDING SHEET PANELS HAVING SIDE EDGE PORTIONS WITH PROJECTIONS MATING WITH GROOVES ON BRACKETS ANCHORED TO ROOF

FIELD OF THE INVENTION

The present invention finds application in the field of building and, more particularly, relates to a roofing assembly having high resistance, suitable for use with roofs of residential and industrial buildings.

BACKGROUND OF THE INVENTION

Modular roofing assemblies are increasingly applied for the protection of buildings or other load-bearing structures, for both residential and industrial use, which assemblies are made of metal sheets having specially profiled edges, and are either pre-assembled or directly mounted to the roofing.

These particular roofing systems have a much lighter weight than conventional solutions, and further assure enhanced universal use.

The connection to the load-bearing structure of the roof is usually obtained by directly attaching the metal sheets to the structure, typically by perforation and/or punching. Furthermore, these sheets are interconnected by placing adjacent sheets in such a manner to provide an overlap relationship between their edges.

As an alternative to the above, the sheets are secured in adjacent positions to brackets, which are in turn fastened to the underlying structure, whereupon the adjacent edges are crimped together by means of special tools.

As is apparent, these conventional solutions have the drawback of requiring a somewhat laborious assembly process, and of requiring the performance of complex operations, using particular tools. Furthermore, the anchorage holes in the sheets are weak points, possibly giving rise to cracks or metal weakening areas, as well as permeable points for the whole structure. Therefore, these structures are excessively vulnerable to weather conditions, particularly rain, in case of possibly imperfect connections, and wind, especially in cantilever roofing assemblies.

In an attempt to obviate the above drawbacks, several solutions have been proposed in which the roofing assembly is connected to the bearing structure by intermediate fastening means, which are anchored to the some structure.

Particularly, from EP-0964114, in the name of the same applicant, a sheet metal roofing structure is known, which comprises metal sheets whose non-adjacent longitudinal edges are suitably shaped with a predetermined profile.

The anchorage of the sheets to the roof of the building is accomplished by means of supporting blocks, which have been previously mounted to the structure, and have alternating projections and recesses, to define a profile that is complementary to the sheet edges. This allows the sheets to be joined together by partial overlapping of their edges and snap fit in anchor blocks.

This arrangement allows anchorage and quick overlapping connection of adjacent metal sheets by exerting a downward force that allows such sheets to slide in the connection seats defined by the alternating projections and recesses of the blocks.

Moreover, from EP-A-0124707 is known a roof structure having all the features of the preamble of the main claim 1.

While these arrangements provide an easy-to-mount covering assembly, having excellent characteristics of load and weather resistance and impermeability, it still has a few drawbacks and is susceptible to improvements.

SUMMARY OF THE INVENTION

The object of this invention is to overcome the above drawbacks, by providing a modular roofing assembly that is highly efficient and relatively cost-effective.

A particular object is to provide a roofing assembly that has high stability and resistance even when subjected to stresses acting substantially transverse to the extension of the assembly.

Another particular object of the invention is to provide a roofing assembly that can be easily assembled and dismantled.

Yet another object of the invention is to provide a roofing assembly whose properties are not affected by bad weather, particularly strong wind and/or rain.

These objects, as well as other objects that will be more apparent hereafter, are fulfilled by a roofing assembly as described and claimed herein.

Thanks to this particular configuration, the invention provides a roofing assembly that can enhance the retaining action of said brackets substantially perpendicular to said central portion and increase the separation load, causing the separation of said edge portions from said brackets. Therefore, the assembly will have high stability and resistance when subjected to stresses acting in any direction, and particularly stresses that are substantially transverse to the extension of the assembly.

Preferably, the angle of inclination of the opposing upper surfaces of the first longitudinal projection and the groove with respect to the central portion of each of the panels may range between −10 to 15 degrees and will be preferably about 5 degrees.

Advantageously, the first longitudinal projection may be defined by a tooth formation having a lateral width at least equal to the maximum lateral depth of the first longitudinal groove in which it is engaged. Furthermore the lateral top of the tooth may be substantially in contact engagement with the bottom of the groove.

This particular feature of the invention will add stability to the assembly and allow it to be easily mounted, by simply exerting a downward pressure on the panels.

Advantageously, each of the brackets may have at least one cavity, preferably a through hole, formed on the lower surface of its base body, allowing the passage of connecting members for permanent anchorage to the support structure.

This arrangement will further simplify the mounting of the whole roofing system, and allow simple removal of individual panels for replacement or for changing the roofing configuration.

Suitably, the brackets may have two longitudinal grooves to house and engage in a snap-fit relationship the first longitudinal projections of adjacent joined panels.

Also, each of said brackets may have two first longitudinal appendixes, extending from the base body of its respective bracket. The appendixes may be symmetrical with respect to a central plane, that is, substantially perpendicular to the central portion and parallel to the edge portions, and may have an outer surface and an inner surface.

Advantageously, the longitudinal grooves may be formed on the corresponding outer surfaces of the first longitudinal appendixes.

Thus, the supporting brackets will evenly support the load exerted by the panels, thereby enhancing stability even against considerable stresses, such as the thrust exerted by strong winds.

Each of said brackets may preferably comprise two second lateral extensions, symmetrical with respect to the central plane and mutually convergent.

Also, the edge portions of the sheet panels may include second complementary projections shaped with respect to a corresponding second lateral extensions of the brackets, and which may further have a third projection between the first and the second projections.

Advantageously, the second lateral appendixes may be at least partly facing the first longitudinal appendixes, at the outer surfaces thereof, to form respective seats for transverse sliding engagement of the third projections of the edge portions.

Thanks to this particular configuration of the invention, the assembly may be assembled in a very simple and stable manner and the whole assembly may be also easily dismantled, wholly or partly by sliding disengagement of one or more panels.

Conveniently, the inner surfaces of the first longitudinal appendixes may be transversely staggered and mutually opposite to form a central channel in the bracket. Furthermore, the margins of the opposing edge portions of each panel may be appropriately shaped to allow mutual overlapping and insertion thereof in one or more brackets in the central channel.

This further feature of the invention will provide a roofing assembly having unchanged features even when subjected to bad weather, such as strong rains. The assembly will have a channel for rain water drainage and will further cover the whole roof of the building on which it is mounted, thereby affording a high visual uniformity.

BRIEF DESCRIPTION OF THE DRAWINGS

Further characteristics and advantages of the invention will be more apparent from the detailed description of a preferred, non-exclusive embodiment of a roofing assembly according to the invention, which is described as a non-limiting example with the help of the annexed drawings, in which.

DETAILED DESCRIPTION OF A PREFERRED EMBODIMENT

Referring to the above figures, the assembly of the invention, generally designated with numeral 1, may provide, as shown in the figures, a roofing assembly having high resistance, particularly suitable for use with roofs of residential and industrial buildings.

Figure 1:
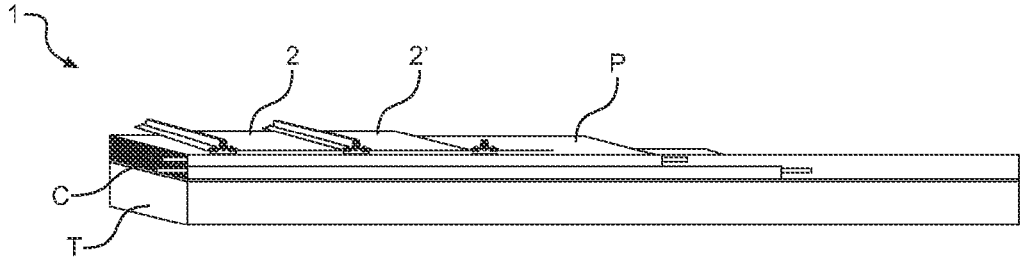
FIG. 1 is a perspective view of a roofing assembly according to the invention.

As particularly shown in FIG. 1, the assembly is composed of a plurality of modular sheet panels 2, disposed in adjacent positions to form a roofing system for a roof T. The anchorage of these panels to the load bearing structure is carried out by using a plurality of anchor brackets 6, which may be connected to the purlin or any other support of the roof T. The structure of the latter may include one or more intermediate insulation panels P under the sheet panels 2 and service channels may be provided between the building structure and the panels 2.

Figure 2:
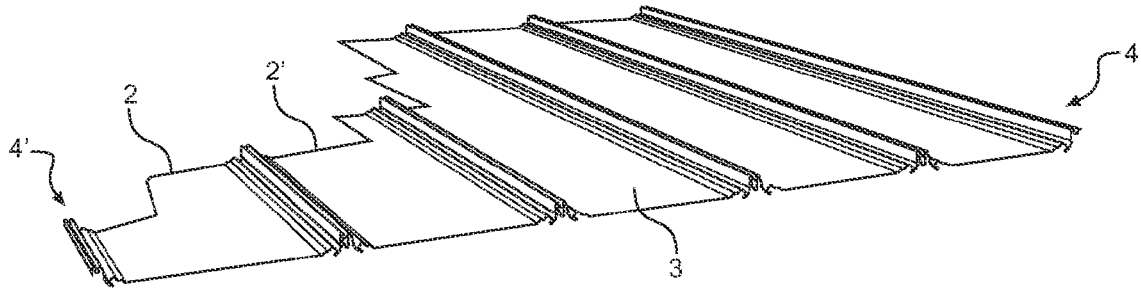
FIG. 2 is a perspective view of a detail of the assembly of FIG. 1.
Figure 3:
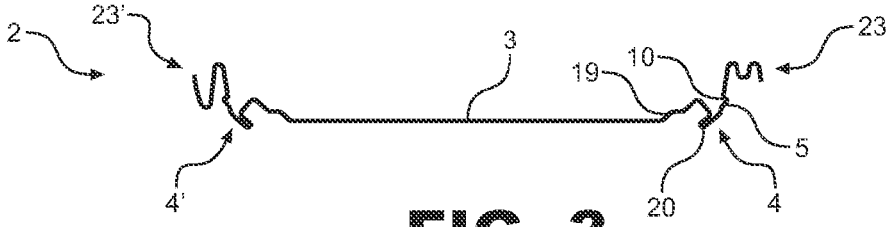
FIG. 3 is a front view of the detail of FIG. 2.

As shown in FIGS. 2 and 3, the sheet panels 2 have a substantially flat central portion 3, and two substantially parallel side edge portions 4, 4'. The panels are interconnected along the side edge portions 4, 4' by placing the latter in overlapping relationship.

The panels 2 are preferably formed from a metal material or a metal alloy, such as aluminum, steel, zinc or copper.

Figure 4:
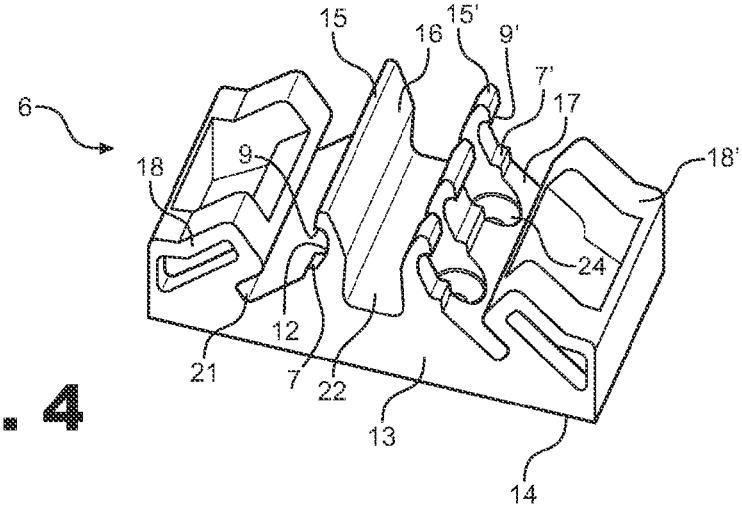
FIG. 4 is a perspective view of a further detail of the assembly of FIG. 1.

On the other hand, the longitudinal panels 2 are mounted to the roof T of the building, by joining said side edge portions 4, 4' to the brackets 6 that are anchored to the roof T. As shown in FIG. 4, each bracket 6 has a base body 13 with a lower surface 14 designed to contact engage the roof T on which the bracket 6 is anchored.

The brackets 6 may be connected to the roof T by means of two cavities or through holes 24 formed on the lower surface 14 of each bracket 6. These will allow the passage of members for permanent anchorage to the support structure, such as screws and bolts, or normal pins.

The brackets 6 may be made of a composite rigid material, such as reinforced polyamide, and may be formed using common processing methods, particularly molding.

Figure 5:
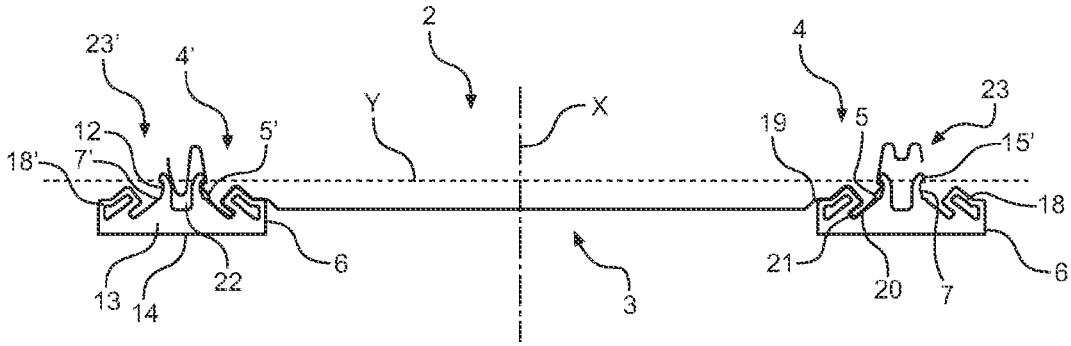
FIG. 5 is a front view of a detail of the assembly of FIG. 1.
Figure 6:
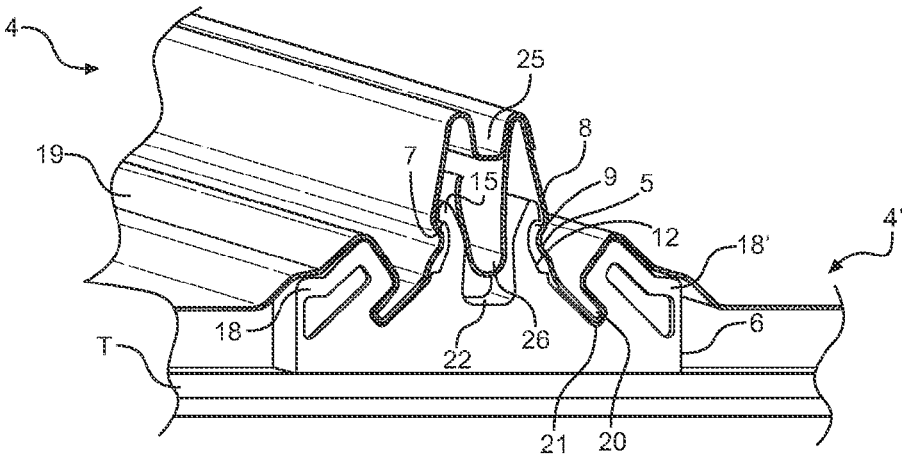
FIG. 6 is a perspective view of a detail of the assembly of FIG. 1.
Figure 7:
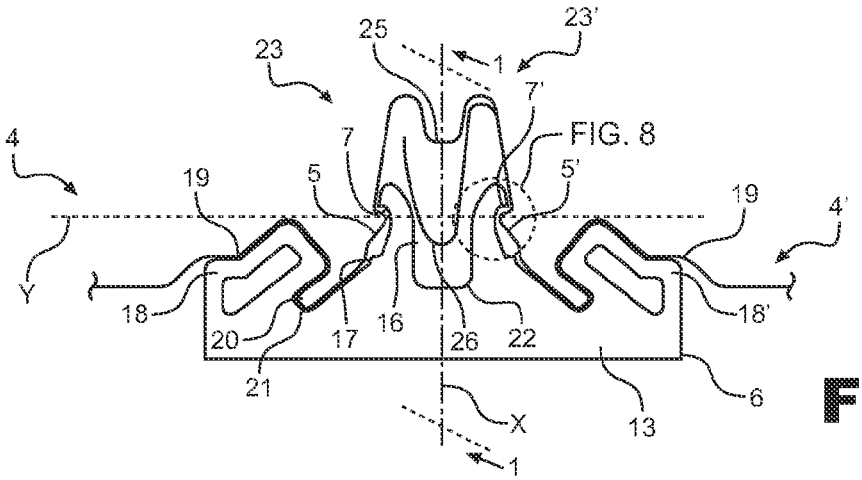
FIG. 7 is a front view of the detail of FIG. 6.

The edge portions 4, 4', as shown in FIGS. 5 and 6, are specially shaped to define first longitudinal projections 5 facing laterally outwards in a direction Y substantially parallel to the central portion 3 of the panels 2.

Each bracket 6 may have, in turn, two longitudinal grooves 7, 7' to accommodate in a snap fit relationship the longitudinal projections 5 of adjacent panels 2, 2' to be joined.

According to the invention, the longitudinal projections 5 and the grooves 7 have opposing upper surfaces 8, 9 that are at least partially flat and substantially parallel or slightly inclined with respect to the central portion 3.

This will enhance the retaining action R of the brackets 6 on the panels 2 in a direction X substantially perpendicular to the central portion 3 and, as a result, the separation load p causing the separation of the edge portions 4, 4' from the brackets 6 will increase.

Figure 8:
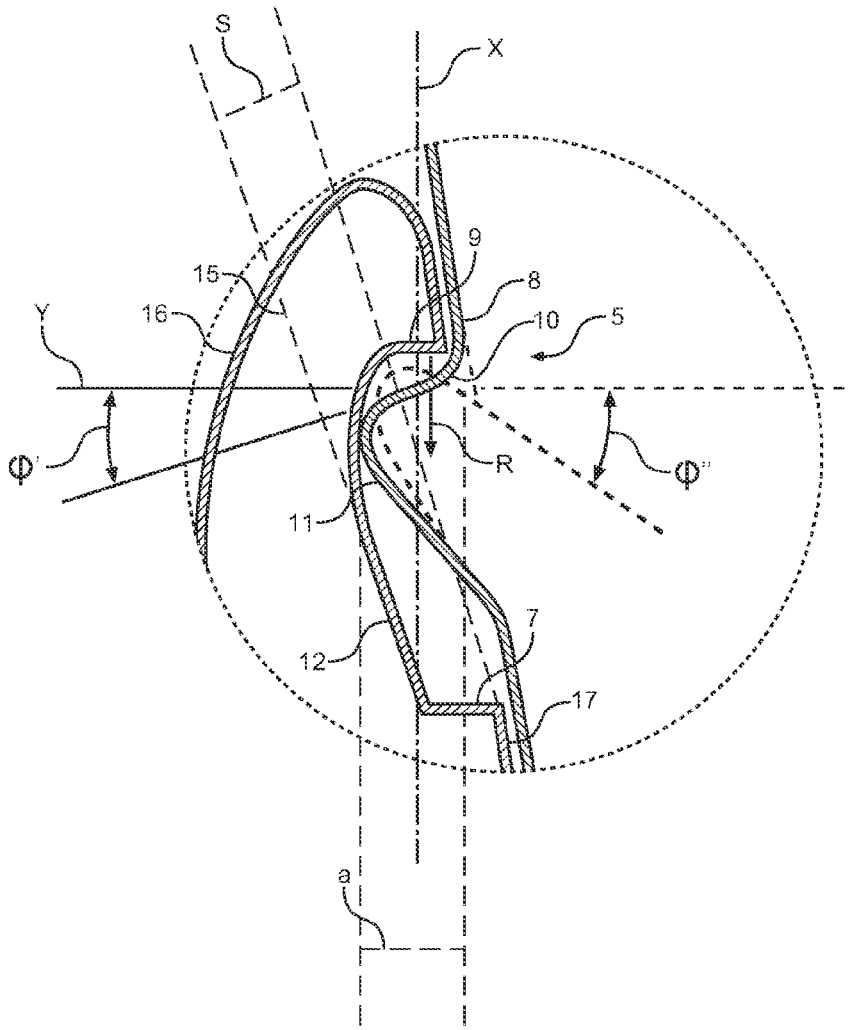
FIG. 8 is an enlarged view of a detail of FIG. 7.

As particularly shown in FIG. 8, the angle of inclination $\phi$ of the upper surfaces 8, 9 with respect to the central portion 3 of each panel 2 may be in a range from a value $\phi''=-10°$ and a value $\phi''=15°$ and will be preferably of about 5°.

Furthermore, each first longitudinal projection 5 may be defined by a tooth element 10 having a lateral width a at least equal to the maximum lateral depth s of the first longitudinal groove 7 in which it is engaged.

Furthermore, the lateral top 11 of the tooth 10, which defines the first longitudinal projection 5, may be substantially in contact with the bottom 12 of the longitudinal groove 7 in which it is engaged.

Preferably, the brackets 6 may have two first longitudinal appendixes 15, which extend from the base body 13 and are substantially symmetrical with respect to a central plane l-l that is substantially perpendicular to the central portion 3 and substantially parallel to the edge portions 4, 4' of each panel 2. The extensions 15 further have an inner surface 16 and an outer surface 17.

Conveniently, the longitudinal grooves 7 may be formed on the corresponding outer surfaces 17 of the longitudinal extensions 7.

The brackets 6 may advantageously comprise two second lateral extensions 18, which are substantially symmetrical with respect to the central plane l-l and mutually convergent.

The edge portions 4, 4' of the sheet panels 2 will in turn include second projections 19, whose shapes are complementary to their respective second lateral extensions 18 with which they are to be joined.

Also, the edge portions 4, 4' may have a third projection 20 facing away from the projections 5, 19 and in an intermediate position between them.

Suitably, each of the second lateral extensions 18 may be disposed at least partly opposite one of the outer surfaces 17 of the first longitudinal appendixes 15. Thus, two seats 21 will be formed for transverse sliding engagement of the third projections 20 of the edge portions 4, 4'.

Preferably, the inner surfaces 16 of the first longitudinal appendixes 15 may be transversely staggered and mutually opposite to form a central longitudinal channel 22 in each bracket 6. Furthermore, the margins 23, 23' of the side edge portions 4, 4' of adjacent panels 2, 2' may be appropriately shaped to allow overlapping and insertion thereof in the central channel 2'. Particularly, the margins 23, 23' will be folded to form one or more elbows, which define two more channels 25, 26 for water drainage, above the central channel 22.

Also, the interconnection between edge portions 4, 4' of adjacent panels 2, 2' will be highly elastic, and accommodate any transverse expansion caused by unavoidable thermal alternation effects on the assembly. Longitudinal thermal expansion will be completely unrestrained, no restraint being provided in the longitudinal direction, with the friction between panels 2 and brackets 6 only limiting or hindering any longitudinal movement. This allows forming panels of any length, even above 100 meters.

Figure 9:
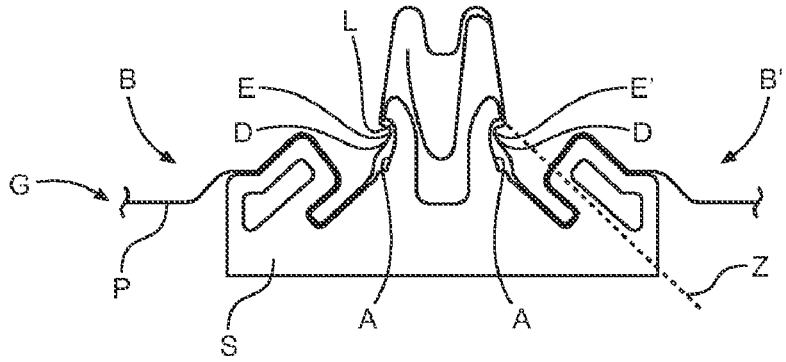
FIG. 9 PRIOR ART
FIG. 9 is a front view of a detail of a prior art assembly.

FIG. 9 schematically shows a detail of a prior art roofing assembly, in which the bracket S has two grooves A for accommodating in a snap fit relationship two tooth elements D formed on opposite edge portions B, B' of a sheet panel P. The elements D have respective upper surfaces E, E' with steep inclinations with respect to the central portion G of the panel P, and not parallel to the upper surface L of their respective grooves A. As a result, the bracket will have a weaker retaining action F, in a non vertical direction Z.

Figure 10:
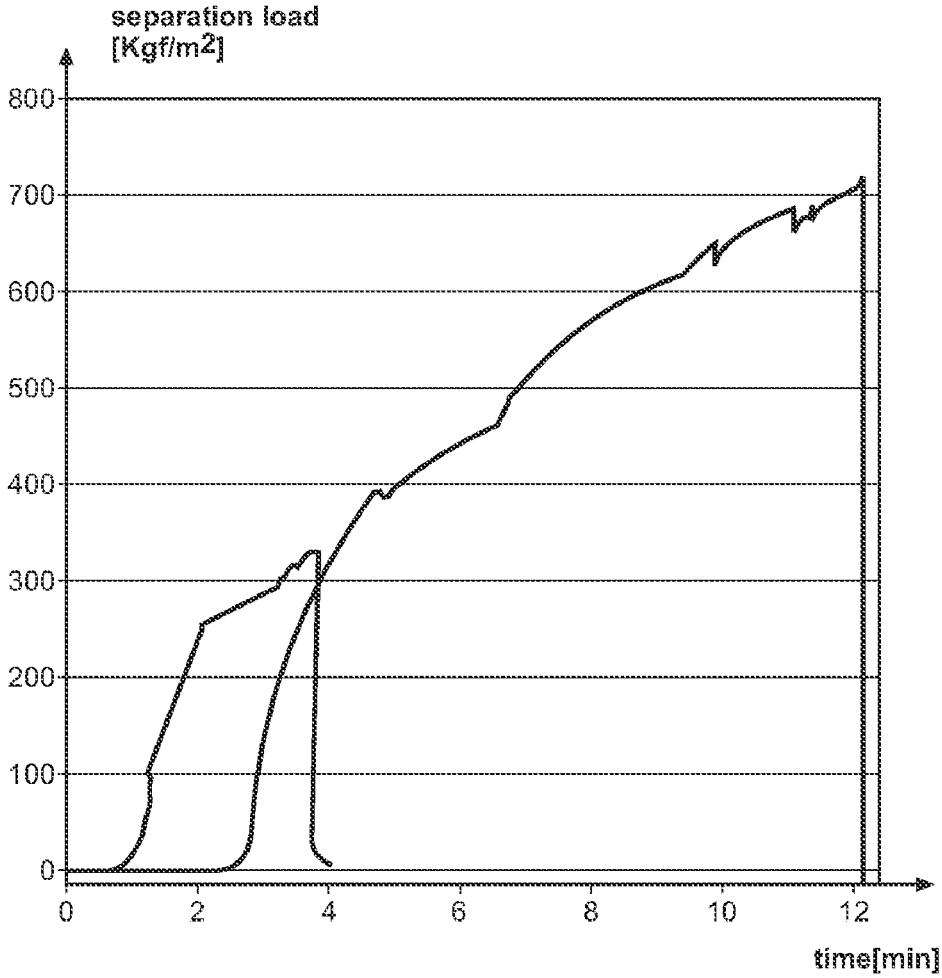
FIG. 10 is a pressure vs time diagram of an "airbag test" performed on an assembly according to the invention as compared with an identical test performed on a prior art assembly.

The comparison between the separation loads p, p' resulting from the inventive assembly and a comparative prior art roofing assembly is illustrated in the pressure vs time diagram of FIG. 10. These values were obtained in an air bag test, during which the assemblies were subjected to air pressure through a plastic membrane under the assembly. The values related to the inventive assembly are shown as a solid line, whereas the prior art assembly values are shown as a dotted line.

The assembly of the invention has apparently achieved a separation load p of 721.7 kgf/m$^2$ after 12 minutes and 30 seconds, whereas, in the same test, the prior art assembly achieved a separation load of 321.8 kgf/m$^2$ after about 4 minutes.

As it is apparent, the assembly of the invention fulfills the intended objects and particularly the requirement of providing a roofing assembly having high stability and resistance when subjected to stresses in any direction.

Furthermore, thanks to the particular design of the support brackets and to the particular shape of the panel edges, the connections between brackets and panels provide an assembly that can be easily assembled and dismantled.

The details thereof may be replaced by other technically equivalent parts, and the materials may vary depending on different needs, without departure from the scope of the invention as described by the appended claims.

While the assembly has been described with particular reference to the accompanying figures, the numerals referred to in the disclosure and claims are only used for the sake of a better intelligibility of the invention and shall not be intended to limit the claimed scope in any manner.

The invention claimed is:

1. A roofing assembly comprising:

a plurality of modular sheet panels each having a substantially flat central portion and first and second side edge portions, the plurality of sheet panels being configured to be reciprocally coupled in side-by-side positions by placing said first side edge portion of a first sheet panel of said sheet panels in an at least partially overlapping relationship with said second side edge portion of a second sheet panel of the sheet panels; and a plurality of brackets configured to be anchored to a roof for securing said sheet panels at the side edge portions thereof, each of said brackets having a base body with a lower surface designed to engage the roof to which it is anchored;

wherein each of the first side edge portions is shaped to define a first longitudinal projection extending outwardly in a direction substantially parallel to one flat central portion of said flat central portions of said sheet panels, and each of said second side edge portions is shaped to define a second longitudinal projection extending outwardly in a direction substantially parallel to one flat central portion of said flat central portions of said sheet panels, wherein each of the brackets includes a first longitudinal groove and a second longitudinal groove each shaped for housing and snap-fit engaging respectively the first longitudinal projections and the second longitudinal projections of the sheet panels in an engaging position therewith, wherein said first and said second longitudinal projections and said first and second longitudinal grooves each have upper surfaces that are at least partially flat and substantially parallel or slightly inclined with respect to said central portions of said sheet panels, such that when the first and the second longitudinal projections and the first and the second longitudinal grooves are placed in the engaging position, a retaining action of said brackets in a direction substantially perpendicular to said central portions of said sheet panels is enhanced, and a separation load causes the separation of said sheet panels from said brackets, and wherein each of said brackets has two first longitudinal extensions, which extend from said base body of each of said brackets, said first longitudinal extensions being substantially symmetrical with respect to a central plane that is substantially perpendicular to said central portions of said sheet panels and substantially parallel to said edge portions of said sheet panels, each of said two first extensions having an inner surface and an outer surface.

2. The assembly as claimed in claim 1, wherein the upper surfaces of each of said first longitudinal projections and of one of said first and second longitudinal grooves are each inclined, with respect to said central portions of said sheet panels, an angle comprised between about −10 and 15 degrees.

3. The assembly as claimed in claim 1, wherein each of said first and said second longitudinal projections comprises a tooth element having a lateral width that is at least equal to the maximum lateral depth of one of said first and second longitudinal grooves.

4. The assembly as claimed in claim 3, wherein an upper lateral portion of each of said tooth elements is shaped to be substantially in contact with a bottom portion of one of said first and second longitudinal grooves in the engaging position.

5. The assembly as claimed in claim 1, wherein the first sheet panel and the second sheet panel of the sheet panels are disposed adjacently to each other.

6. The assembly as claimed in claim 1, wherein said first and second longitudinal grooves are formed on the respective outer surfaces of said first longitudinal extensions.

7. The assembly as claimed in claim 1, wherein each of said brackets comprises two second lateral extensions, which are substantially symmetrical with respect to said central plane and mutually convergent.

8. The assembly as claimed in claim 7, wherein each of said first and said second side edge portions of said sheet panels have third specially shaped projections, each of said third specially shaped projections having a shape complementary to one of said second lateral extensions, and each of said first and said second side edge portions having a fourth projection between said first and second longitudinal projections.

9. The assembly as claimed in claim 8, wherein each of said second lateral extensions is at least partly opposite the outer surface of its respective first and second longitudinal extension, to form respective seats for transverse sliding engagement of said fourth projections.

10. The assembly as claimed in claim 1, wherein said inner surfaces of said first longitudinal extensions are transversely staggered and mutually opposite to form a central longitudinal channel in said brackets.

11. The assembly as claimed in claim 10, wherein end portions of said side edge portions of adjacent ones of said sheet panels are appropriately shaped to define respective drainage channels, allowing overlapping and insertion thereof in said central channel of one or more of said brackets.

12. The assembly as claimed in claim 1, wherein each of said brackets has at least one cavity, formed on said lower surface of said base body of each of said brackets, allowing the passage of members for permanent anchorage to the roof.

* * * * *